US008708129B2

(12) United States Patent
Gunst et al.

(10) Patent No.: US 8,708,129 B2
(45) Date of Patent: Apr. 29, 2014

(54) METHOD AND SYSTEM FOR DUST PREVENTION IN A COIN HANDLING MACHINE

(75) Inventors: Robert E. Gunst, Neosho, WI (US); Thomas P. Adams, Oconomowoc, WI (US); Jason R. Parpart, Whitewater, WI (US); Myron W. Spoehr, Lake Mills, WI (US)

(73) Assignee: Talaris, Inc., Watertown, WI (US)

( * ) Notice: Subject to any disclaimer, the term of this patent is extended or adjusted under 35 U.S.C. 154(b) by 1247 days.

(21) Appl. No.: 11/893,698

(22) Filed: Aug. 17, 2007

(65) Prior Publication Data

US 2009/0045031 A1 Feb. 19, 2009

(51) Int. Cl.
*G07D 7/00* (2006.01)

(52) U.S. Cl.
USPC ..... 194/302; 194/328; 382/136

(58) Field of Classification Search
USPC ..... 194/302, 328, 329, 334–338; 453/6, 7, 453/10–13, 33–35, 49, 56, 57; 382/136
See application file for complete search history.

(56) References Cited

U.S. PATENT DOCUMENTS

| | | | | |
|---|---|---|---|---|
| 4,088,144 | A | 5/1978 | Zimmermann | |
| 4,769,532 | A | 9/1988 | Kawakami | |
| 5,135,435 | A | 8/1992 | Rasmussen | |
| 5,163,868 | A | 11/1992 | Adams et al. | |
| 5,767,506 | A * | 6/1998 | Bell | 250/221 |
| 5,799,767 | A | 9/1998 | Molbak | |
| 5,879,626 | A | 3/1999 | Watterson et al. | |
| 6,484,865 | B1 * | 11/2002 | Hibari et al. | 194/328 |
| 6,640,956 | B1 * | 11/2003 | Zwieg et al. | 194/328 |
| 6,679,770 | B1 | 1/2004 | Sugai et al. | |
| 6,920,972 | B2 * | 7/2005 | Speas et al. | 194/203 |
| 7,017,729 | B2 | 3/2006 | Gerrity et al. | |
| 7,383,934 | B2 * | 6/2008 | Yamagishi | 198/341.03 |
| 2004/0011620 | A1 | 1/2004 | Molbak | |
| 2004/0027576 | A1 * | 2/2004 | De Groot et al. | 356/498 |
| 2004/0200027 | A1 * | 10/2004 | Sugihara | 15/301 |
| 2006/0022945 | A1 | 2/2006 | Vook et al. | |
| 2006/0191770 | A1 | 8/2006 | Gerrity et al. | |
| 2006/0219876 | A1 | 10/2006 | Halter | |
| 2007/0153385 | A1 * | 7/2007 | Sakai et al. | 359/511 |

FOREIGN PATENT DOCUMENTS

| | | | |
|---|---|---|---|
| DE | 297 20 290 | U1 | 1/1998 |
| DE | 297 20 290 | U1 | 2/1998 |
| GB | 2 418 485 | A | 3/2006 |
| JP | 0 306 3795 | A | 3/1991 |
| JP | 0 309 2994 | A | 4/1991 |

(Continued)

*Primary Examiner* — Jeffrey Shapiro
(74) *Attorney, Agent, or Firm* — Boyle Fredrickson, S.C.

(57) ABSTRACT

A method and system for prevention of dust accumulation on a coin sensor assembly (67) in a coin handling machine (60), includes a lower optical element (83, 90) positioned below a coin track (63) and then either, or both of, 1) blowing off dust that tends to accumulate on the cover (83) for the lower optical element (90) and 2) coating the cover (83) for the lower optical element (90) with a transparent conductive coating (83*a*) that is electrically grounded to prevent accumulation of dust due to static electrical attraction. A fan unit (82) is positioned adjacent the cover (83) for blowing dust off the cover (83) during operation of the coin handling machine (60). The method and system is preferably a optical reflector system with an upper optical element in the form of a reflector (86, 87) and a transparent conductive coating of material (87*a*) is also provided on the reflector (86, 87).

24 Claims, 14 Drawing Sheets

(56) References Cited

FOREIGN PATENT DOCUMENTS

| | | | |
|---|---|---|---|
| JP | 0 622 3256 | A | 8/1994 |
| JP | 1 026 1127 | A | 9/1998 |
| JP | 1 026 1129 | A | 9/1998 |
| WO | 01/91063 | A1 | 11/2001 |
| WO | WO 01/91063 | A1 | 11/2001 |

* cited by examiner

METHOD AND SYSTEM FOR DUST PREVENTION IN A COIN HANDLING MACHINE

TECHNICAL FIELD

The invention relates to coin handling equipment and, more particularly, equipment for counting coinage and detecting invalid coins.

BACKGROUND ART

In Zwieg et al., U.S. Pat. No. 5,992,602, coins were discriminated by using an inductive sensor to take three readings as each coin passed through a coin detection station and these readings were compared against prior calibrated limits for the respective denominations. If a coin did not fall within certain specifications it was offsorted.

The optical sensing of coins in coin handling equipment has been known since Zimmermann, U.S. Pat. No. 4,088,144 and Meyer, U.S. Pat. No. 4,249,648. Zimmermann discloses a linear rail sorter with a row of photocells disposed across a coin track. Zimmermann does not disclose repeated measurements of a coin dimension as it passes the array, but suggests that there may have been a single detection of the largest dimension of the coin based on the number of photocells covered by a coin as it passes. Zimmermann does not disclose the details of processing any coin sensor signals derived from its photosensor.

Meyer, U.S. Pat. No. 4,249,648, discloses optical imaging of coins in a bus token collection box in which repeated scanning of chord length of a coin is performed by a 256-element linear light sensing array. Light is emitted through light transmissive walls of a coin chute and received on the other side of the coin chute by the light sensing array. The largest chord length is compared with stored acceptable values in determining whether to accept or reject the coin.

Brandle et al., U.S. Pat. No. 6,729,461, assigned to the assignee herein, disclosed a sensor with both optical and inductive sensors at a coin station within a coin sorting apparatus. Although the hybrid sensor was satisfactory for coin discrimination, it had certain drawbacks. One drawback was that dirt and dust tended to build up on a sapphire window portion of the optical sensor, thereby interfering with operation of the optical sensor. The sapphire window portion was positioned in the coin track where coins passed over the window. Still another drawback was manufacturing cost.

Therefore, a new coin counting/discrimination sensor is needed to overcome these limitations.

SUMMARY OF THE INVENTION

A method and system for prevention of dust accumulation on a coin sensor assembly in a coin handling machine, includes spacing a lower optical element from a stationary coin track and in more detailed embodiments either, or both of, 1) blowing off dust that tends to accumulate on the lower optical element spaced from the coin track and 2) coating the lower optical element with a conductive, grounded transparent coating to neutralize attraction of dust due to static electrical attraction.

In a further aspect of the invention the lower optical element has a transparent cover member, and a fan is positioned adjacent the cover member for the lower optical element for blowing dust off the lens cover during operation of the coin handling machine.

In a further aspect of the invention, the method and system involve a reflective optical system in which a lower optical element further comprises an illumination source and an optical detector, and the upper optical element that further comprises an optical reflector.

In a further aspect of the invention the optical reflector also has a transparent cover member with a coating of tin indium material to prevent dust buildup from coin handling operations.

One object of the present invention is to provide an optical coin detection sensor that will count the value of coins at a processing rate up to 4500 coins per minute while reducing the need for maintenance over a substantial period of operation.

While the present invention is disclosed in a preferred embodiment based on a coin handling machine of Brandle et al., U.S. Pat. No. 6,729,461, the invention could also be applied as a modification to other types of coin handling machines, including the other prior art described above.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention.

DETAILED DESCRIPTION OF THE PREFERRED EMBODIMENTS

Figure 1:
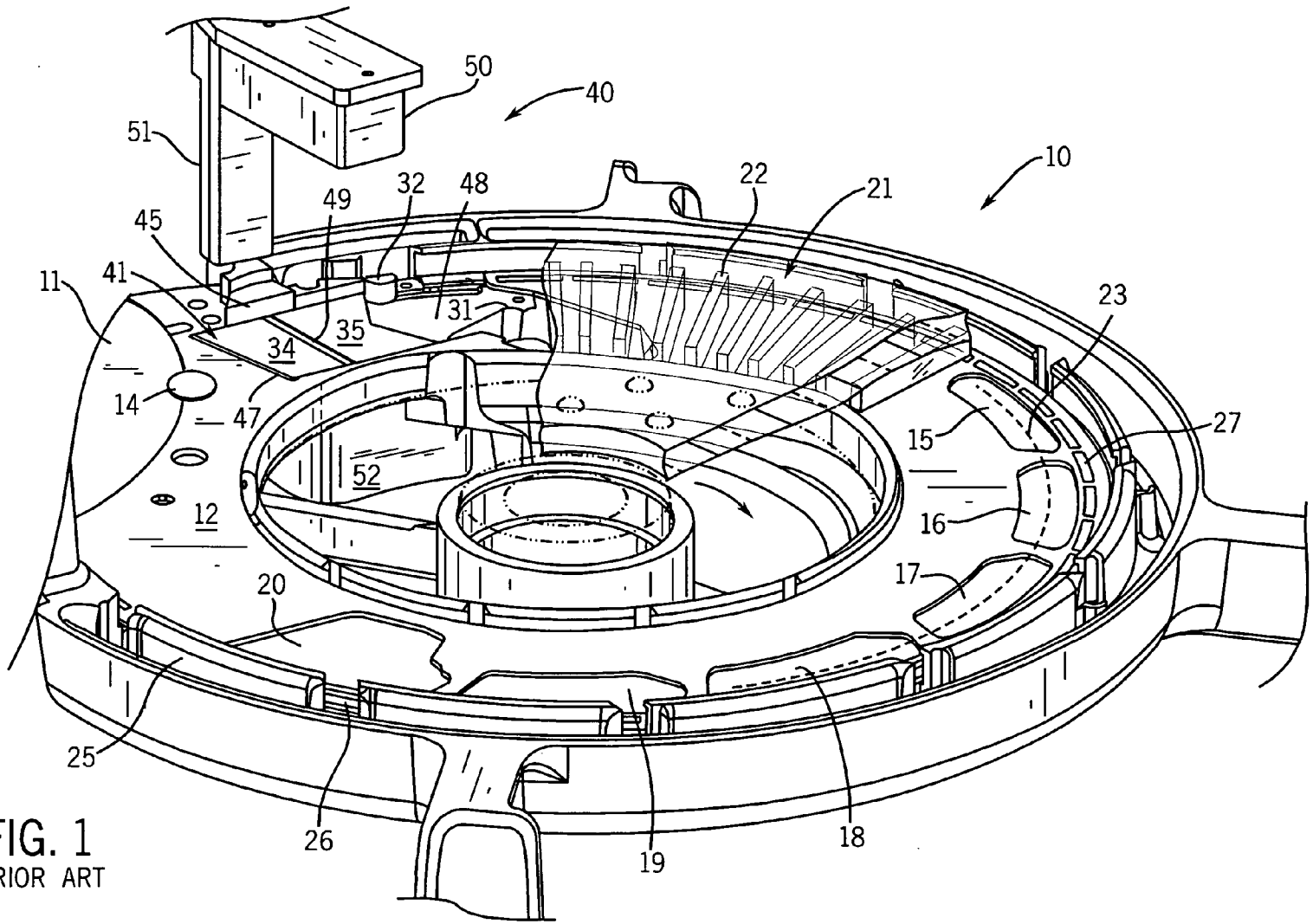
FIG. 1 PRIOR ART
FIG. 1 is a perspective view of a coin handling machine of the prior art.

Referring to FIG. 1, the coin handling machine 10 is a sorter of the type shown and described in Zwieg et al., U.S. Pat. No. 5,992,602, and previously offered under the trade designation, "Mach 12" and "Mach 6" by the assignee of the present invention. This type of sorter 10, sometimes referred to as a figure-8 type sorter, has two interrelated rotating disks, a first disk operating as a feeding disk 11 to separate the coins from an initial mass of coins and arrange them in a single file and single layer of coins 14 to be fed to a sorting disk assembly.

A sorting disk assembly has a lower sorter plate 12 with coin sensor station 40, an offsort opening 31 and a plurality of sorting openings 15, 16, 17, 18, 19 and 20. There may be as many as ten sorting openings, but only six are illustrated for this embodiment. The first five sorting openings are provided for receiving U.S. denominations of penny, nickel, dime, quarter and dollar. From there, the coins are conveyed by chutes to collection receptacles as is well known in the art. The sixth sorting opening can be arranged to handle half dollar coins or used to offsort all coins not sorted through the first five apertures. In some embodiments, as many as nine sizes can be accommodated. It should be noted that although only six sizes are shown, the machine may be required to handle coins with twice that number of specifications. The machine can also be configured to handle the Euro coin sets of the EU countries, as well as coin sets of other countries around the world.

As used herein, the term "sorting opening" and "collection opening" shall be understood to not only include the openings illustrated in the drawings, but also sorting grooves, channels and exits seen in the prior art.

The sorting disk assembly also includes an upper, rotatable, coin moving member 21 with a plurality of fins 22 or fingers which push the coins along a coin sorting path 23 over the sorting openings 15, 16, 17, 18, 19 and 20. The coin moving member is a disk, which along with the fins 22, is made of a light transmissive material, such as acrylic. The coin driving disk may be clear or transparent, or it may be milky in color and translucent.

The fins 22 of this prior art device, also referred to as "webs," are described in more detail in Adams et al., U.S. Pat. No. 5,525,104, issued Jun. 11, 1996. Briefly, they are aligned along radii of the coin moving member 21, and have a length equal to about the last 30% of the radius from the center of the circular coin moving member 21.

A rail formed by a thin, flexible strip of metal (not shown) is installed in slots 27 to act as a reference edge against which the coins are aligned in a single file for movement along the coin sorting path 23. As the coins are moved clockwise along the coin sorting path 23 by the webs or fingers 22, the coins drop through the sorting openings 15, 16, 17, 18, 19 and 20. according to size, with the smallest size coin dropping through the first sorting opening 15. As they drop through the sorting openings, the coins are sensed by optical sensors in the form of light emitting diodes (LEDs) (not shown) and optical detectors (not shown) in the form of phototransistors, one emitter and detector per opening. The photo emitters are mounted outside the barriers 25 seen in FIG. 1 and are aimed to transmit a beam through spaces 26 between the barriers 25 and an angle from a radius of the sorting plate 21, so as to direct a beam from one corner of each opening 15, 16, 17, 18, 19 and 20 to an opposite corner where the optical detectors are positioned.

As coins come into the sorting disk assembly 11, they first pass a coin sensor station 40 with both an optical sensor and an inductive sensors for detecting invalid coins. Invalid coins are off-sorted through an offsort opening 31 with the assistance of a solenoid-driven coin ejector mechanism 32 having a shaft with a semicircular section having a flat on one side, which when rotated to the semicircular side, directs a coin to an offsort transition area 48 and eventually to an offsort opening 31 that is located inward of the coin track 23.

The coin sensor station 40 includes a coin track insert 41 which is part of a coin sensor assembly housed in housing 52. This housing contains a circuit module (not seen) for processing signals from the sensors as more particularly described in U.S. Pat. No. 6,729,461.

Under the coin track are two inductive sensors. One sensor is for sensing the alloy content of the core of the coin, and another sensor is for sensing the alloy content of the surface of the coin. This is especially useful for coins of bimetal clad construction. The two inductive sensors are located on opposite sides of a light transmissive, sapphire window element 49.

The coin track insert 41 is disposed next to a curved rail (not shown) which along with edge sensor housing 45 (FIG. 1) forms a reference edge for guiding the coins along the coin track. An edge thickness/alloy inductive sensor is positioned in the edge sensor housing 45 so as not to physically project into the coin track. Referring to FIG. 1, the coin track insert 41 has an edge 47 on one end facing toward the queuing disk, and a sloping surface 48 at an opposite end leading to the offsort opening 31.

A housing shroud 50 is positioned over the window element 49, and this shroud 50 contains an optical source provided by a staggered array of light emitting diodes (LED's) for beaming down on the coin track insert 41 and illuminating the edges of the coins 14 as they pass by (the coins themselves block the optical waves from passing through). A krypton lamp can be inserted among the LED's to provide suitable light waves in the infrared range of frequencies. The optical waves generated by the light source may be in the visible spectrum or outside the visible spectrum, such as in the infrared spectrum. In any event, the terms "light" and "optical waves" shall be understood to cover both visible and invisible optical waves.

The housing shroud 50 is supported by an upright post member 51 of rectangular cross section. The post member 51 is positioned just outside the coin track 23, so as to allow the optical source to extend across the coin sorting path 23 and to be positioned directly above the window 49.

Figure 2:
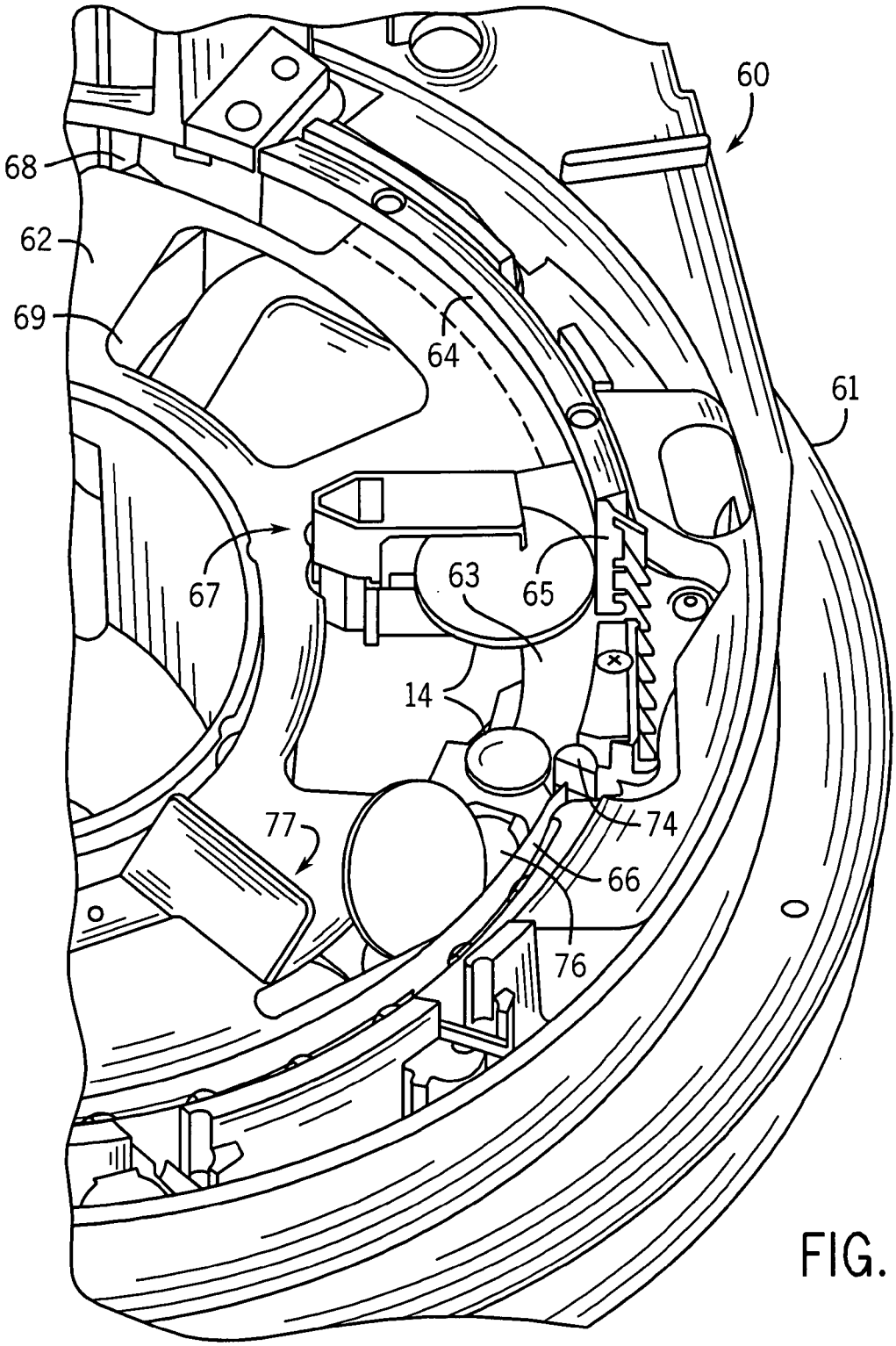
FIG. 2 is a fragmentary perspective view of the coin handling machine of the present invention with parts removed.

Referring now to FIG. 2, in the present invention, a coin handling machine 60 has a dual disk architecture similar to that described above, but has several significant differences.

The new machine 60 is provided in two embodiments, one with sorting openings like the openings 15-20 and another with only a single coin collection opening similar to the largest of the sorting openings 20 seen in FIG. 1. Valid coins of all denominations are collected through this opening 20 after passing a coin sensor assembly 67 and an offsorting slot 76. In the embodiment in which the coin sensor assembly 67 senses the identity of the coin and there is only one collection opening 20, the sensors, optical sensors and optical detectors at each opening are not required, with a resulting savings in cost. In single-opening embodiment, the coins are directed to coin bins of a type disclosed in a copending PCT application of Gunst et al., entitled "COIN BIN AND COIN COLLECTING MACHINE," and designating the United States of America. First, one bin is filled with mixed denominations, and then a second bin is filled with mixed denominations that have been counted with the coin sensor assembly 67 of the present invention.

The present invention is also applicable to an embodiment having coin sorting openings 15-20 for receiving valid coins of respective sizes corresponding to different denominations, either with or without coin detectors at the openings 15-20. In either embodiment, the plane of the sorting plate 62, and thus, the coin track 63, can either be horizontal or angled from horizontal by an amount no greater than thirty degrees, and this shall encompassed by the term "substantially horizontal" in relation to the coin track 63.

Figure 7:
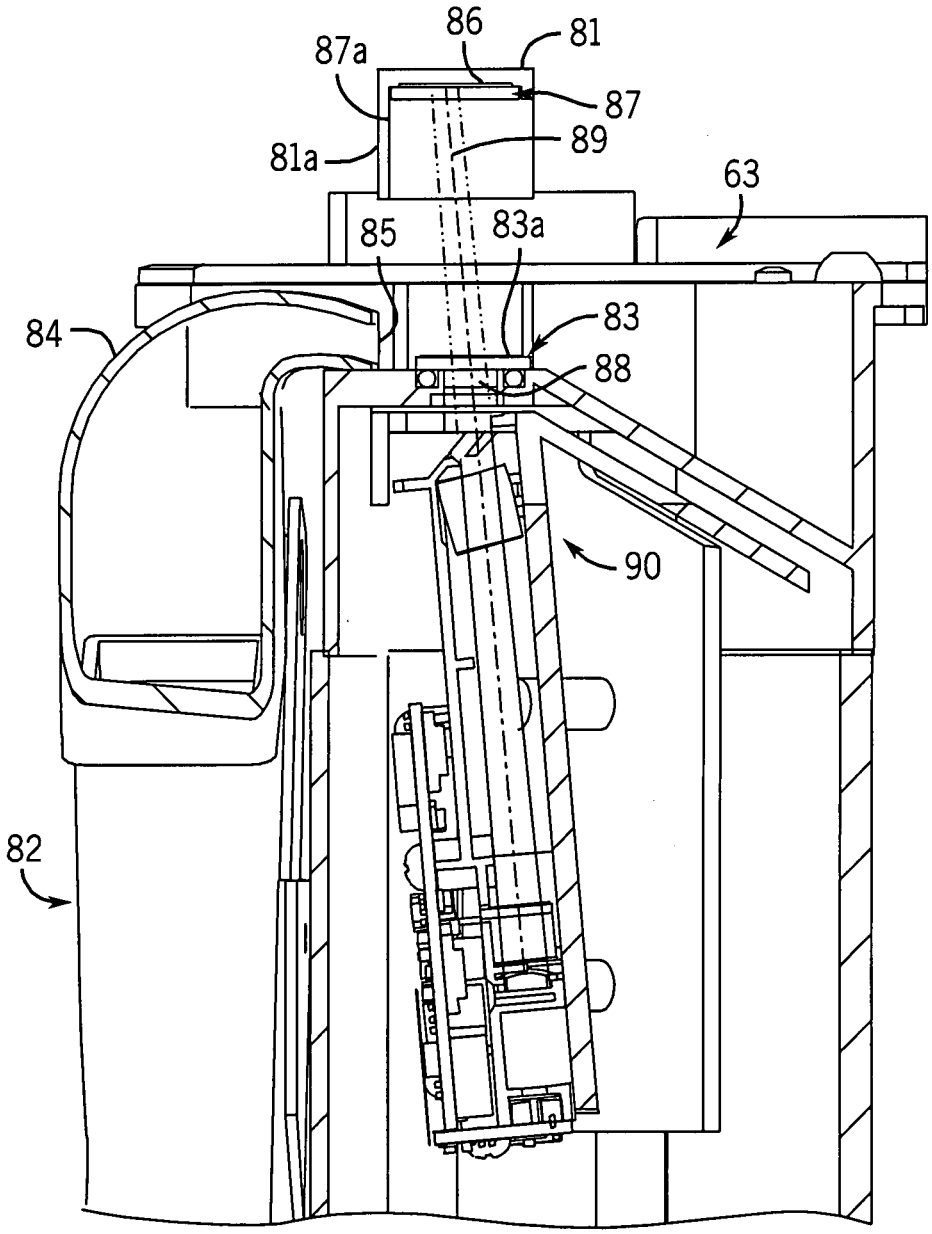
FIG. 7 is a sectional view taken in the plane indicated by line 7-7 in FIG. 6.

The coin sensor assembly 67 will detect a size of an individual coin 14 in a plurality of coins being moved within a coin handling machine 60 and will also detect and offsort invalid coins moving through the coin handling machine 60. The coin handling machine 60 has a base member 61 for supporting a sorting plate 62 having a stationary coin track 63 passing along an outside reference edge 64, 65, 66 that is contacted by outer edges of the coins and that is formed by base member arcuate portion 64, an edge sensor assembly 65 and an upstanding rail 66. Some additional offsorting slots 68, 69 and 70 have been provided for coins not in position along the reference edge. A coin sensor assembly 67 now includes a reflective-type optical sensor and is positioned to the inside of a coin track 63, ahead of the coin sorting slots (not seen in FIG. 2). The light source is now positioned lower than the coin track 63 rather than above it for illuminating at least portions of the coins as the coins move along the coin track 63. As seen in FIG. 7, the shroud portion 81 of the coin sensor assembly 67 has a reflector 86, 87 on its underside positioned above the coin track 63. The shroud has a front depending skirt 81*a* facing the oncoming coins and protecting a zone of a lower optical element 83 from dust buildup. An optical detector 115 is located on a circuit board 95 (FIGS. 8 and 9) that is positioned below the coin track 63 for detecting a size of at least a portion of each coin 14 passing the coin sensor 67 along the coin track 63. A telecentric lens 94 (FIG. 8) is positioned between the optical detector 115 and the coin track 63, such that the portion of each coin passing the optical detector is seen to have an apparent size and configuration independent of a variation in distance of the coin from the telecentric lens as each coin moves along the coin track. This feature of the telecentric lens 94 makes it possible to space optical elements from the coin track 63, which assists in prevention of dust on the optical elements.

Figure 3:
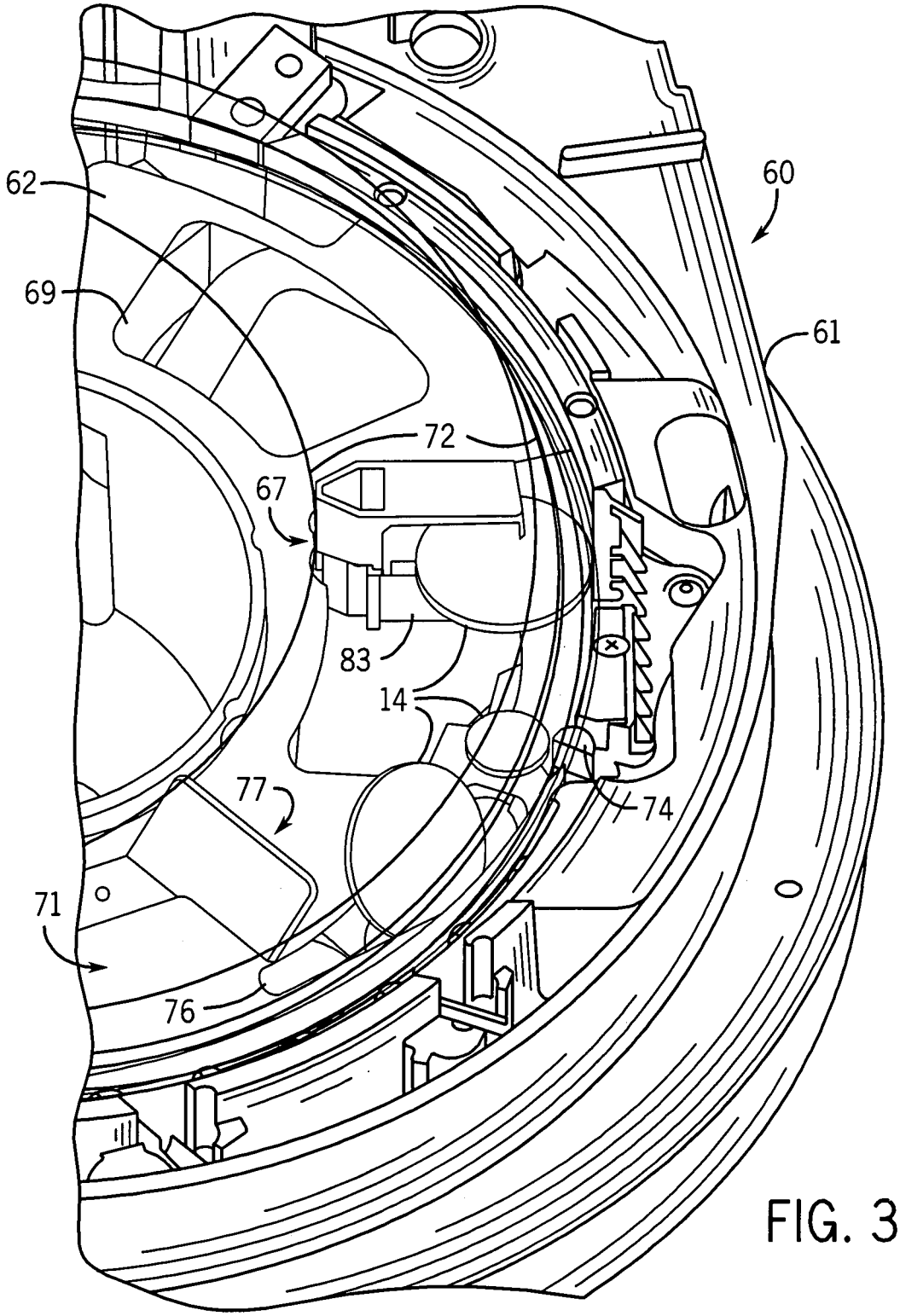
FIG. 3 is a second fragmentary perspective view of the coin handling machine of the present invention with parts made transparent.
Figure 4:
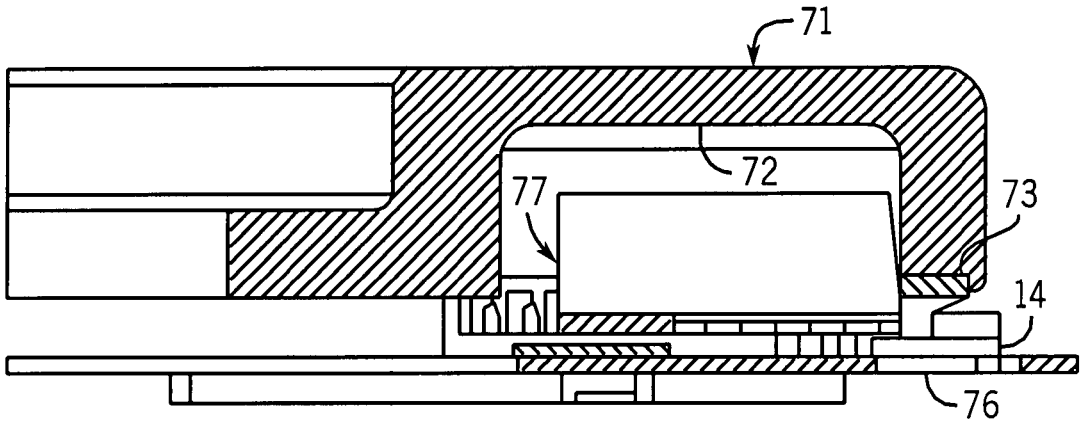
FIG. 4 is a detail sectional view of a portion of the apparatus seen in FIG. 3.

The feeding disk 11 in conjunction with features of the sorting assembly feed the coins onto the coin track in a single layer and a single file in a manner known in the prior art. FIG. 3 shows that the coin moving disk 71 has been modified to provide a recess 72 (see also FIG. 4) for allowing the coin moving disk 71 to pass over the top of the coin sensor assembly 67 and to pass by the coin sensor assembly 67 on opposite sides. The coin moving disk 71 is shown as transparent for illustration purposes only, and in practice can be transparent, semi-opaque or opaque as there is no longer a requirement to shine a light source through the coin moving member 71. The fins or fingers 73 (see also FIG. 4) of the coin moving disk 71 have been made much narrower than in the prior art and now press down on the outside portions of the coins 14 near the reference edge.

This has the effect of tipping up the inside edges of the coins 14 off the coin track 63, which has a width that is narrower than the coins, as seen in FIGS. 2 and 3, so that the coins are cantilevered over, and extend beyond, the inside edge of the coin track 63. The coin moving disk 71 is operable to move the coins along in single file at a rate up to 4500 coins per minute.

The machine 60 has an offsorting arrangement including an offsorting slot 76, a deflector 77 and a solenoid-driven coin diverter 74, all of which are more fully described in a copending U.S. application filed on even date herewith, and entitled "Method and Apparatus for Offsorting Coins in a Coin Handling Machine," the disclosure of which is hereby incorporated by reference.

Figure 5:
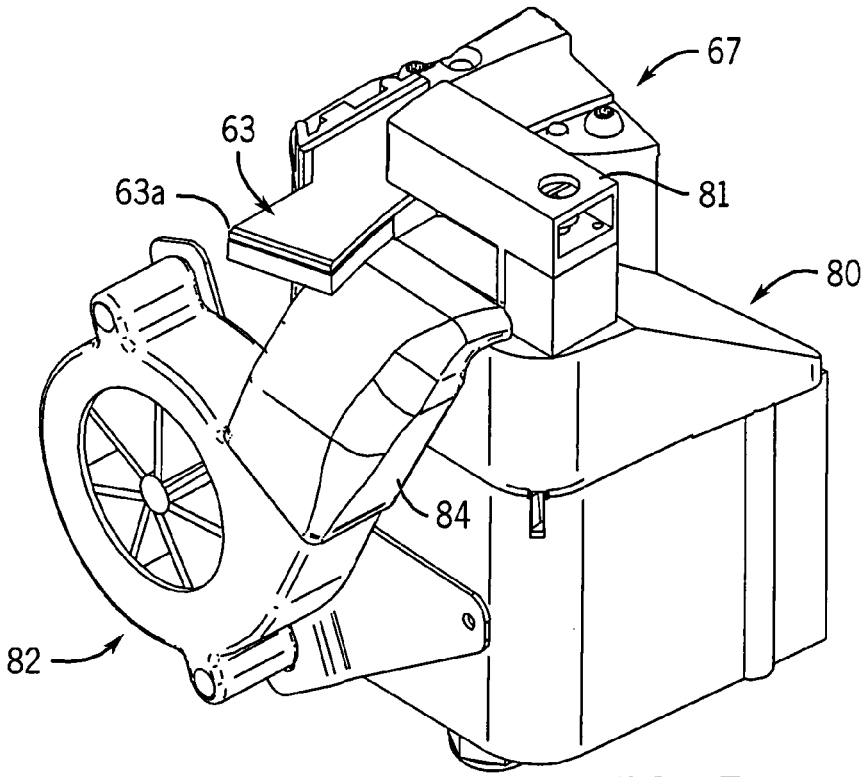
FIG. 5 is a rear perspective view of a sensor assembly of the present invention.
Figure 6:
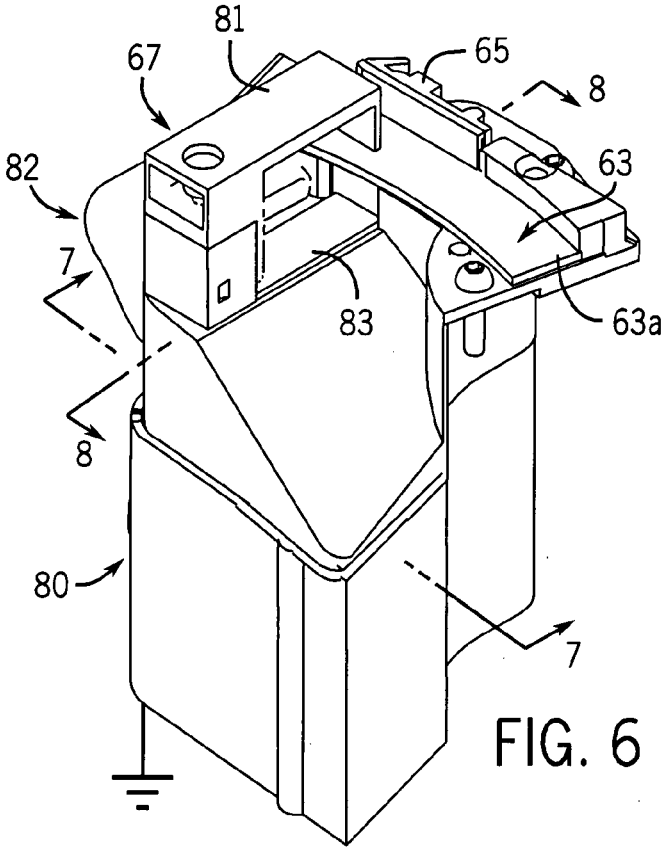
FIG. 6 is a front perspective view of the sensor assembly of FIG. 5.

FIGS. 5 and 6 show the coin sensor assembly 67 which has been removed from the sorting assembly. The portion of the coin track 63, which is part of the sensor assembly 67 has a layer of (specify material) 63*a* to provide wear resistance. The coin sensor assembly 67 assembly is contained in a housing 80. Extending above the housing 80 is a housing shroud 81, which is positioned above a lower transparent cover 83 that covers a slot opening 88 for an optical sensor and detector 90 seen in FIG. 7. In FIG. 5, a fan unit 82 has been added to blow dust off of the lower transparent cover 83. The fan unit 82 has a duct 84 with an opening 85 closely adjacent the cover 83 as seen in FIG. 7. As further seen in FIG. 7, the inside of the housing shroud 81 contains a reflector provided by a sheet of reflective material 86 and an upper transparent cover 87. This reflector is positioned over the slot opening 88 to the optical sensor and detector 90 including a positioning above an inside edge of the coin track. The illumination source in the optical sensor and detector 90 is positioned to send provides parallel beams of light through the slot opening 88 to the undersides of coins and to the inside edge of the coin track 63. The optical sensor and detector assembly 90 includes a line sensor detector on a circuit board 95 shown in FIG. 9. The circuit board 95 further includes a processor 111 (FIG. 14) for receiving signals from the optical detector and for producing size data to be transmitted to a machine controller of a type disclosed in Brandle et al., cited above, for accumulation and display of totals.

In FIGS. 6 and 7, the lower transparent cover 83 is spaced below an inside edge of the coin track 63 by a spacing in a range from 0.1 cm to about 5 cm. In FIG. 7, the reflector 86, 87 is spaced above the inside edge of the coin track 63 in a range from 2.5 cm to about 7.5 cm. This spacing aids the prevention of dust on the coin track 63.

Besides the coin track 63, other elements of the dust prevention system include upper and lower spaced apart transparent optical elements for illuminating a portion of a coin as a plurality of coins move along a coin track in single file. In a more particular feature of the dust prevention system that the lower optical element provides for transmission and reception of illumination to and from the coin 14, while the other element 86, 87 provides for optical reflection. It is a more particular feature illustrated in FIG. 7 that the covers 83 and 87 for the optical elements are each made of glass and provided with an electrically grounded, conductive coating 83*a*, 87*a*, preferably a indium-tin oxide, to neutralize any static electrical charge that would assist dust attraction and accumulation. The covers 83 and 83 contact the housing 80 for the sensor assembly, which is also made of conductive plastic material that is connected to ground represented schematically in FIG. 6. It is still another feature of the dust prevention system that, in FIG. 7, a fan 82 is positioned adjacent the lower optical element for blowing dust off the cover 83 during operation of the coin handling machine 60.

Figure 8:
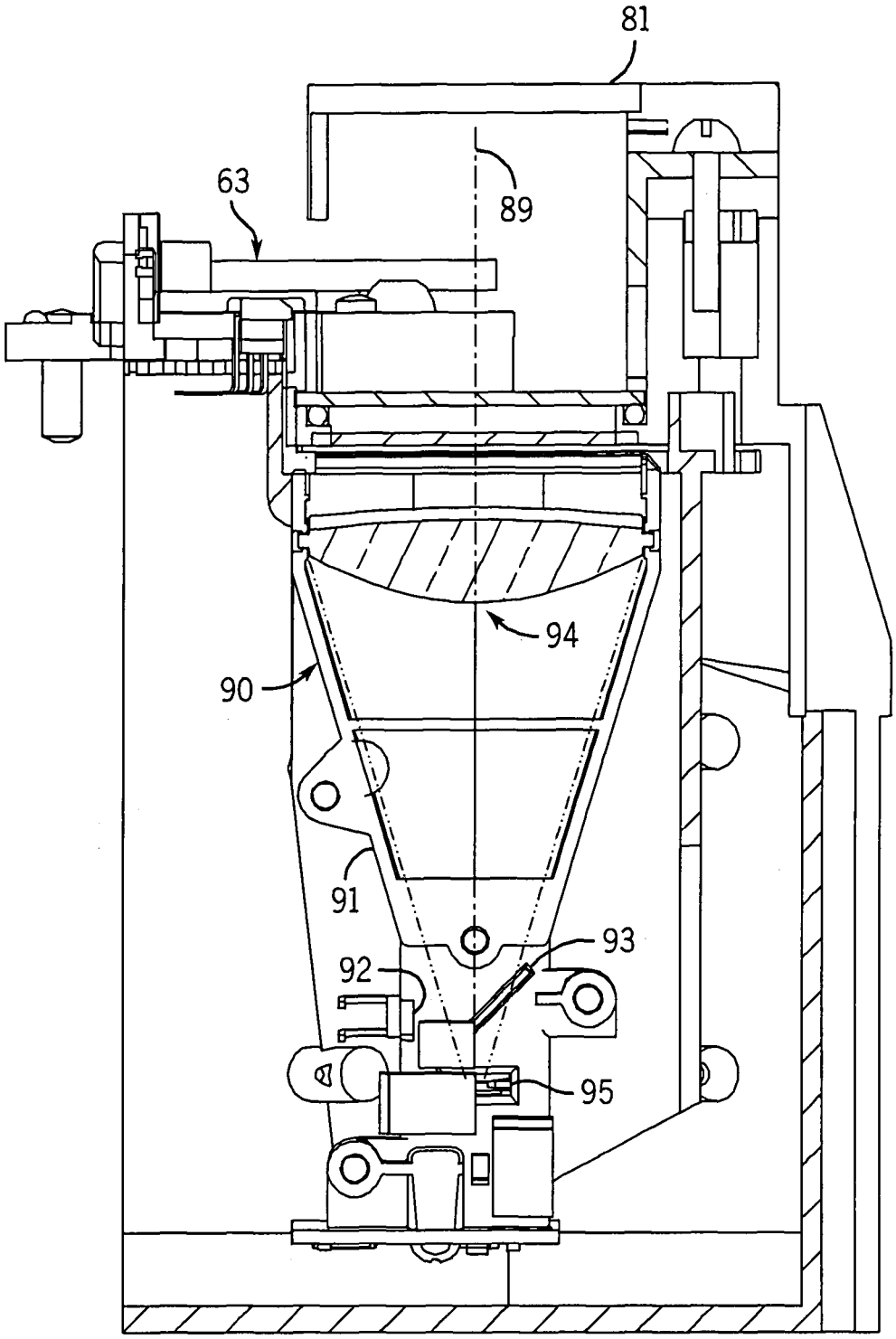
FIG. 8 is a sectional view taken in the plane indicated by line 8-8 in FIG. 6.
Figure 9:
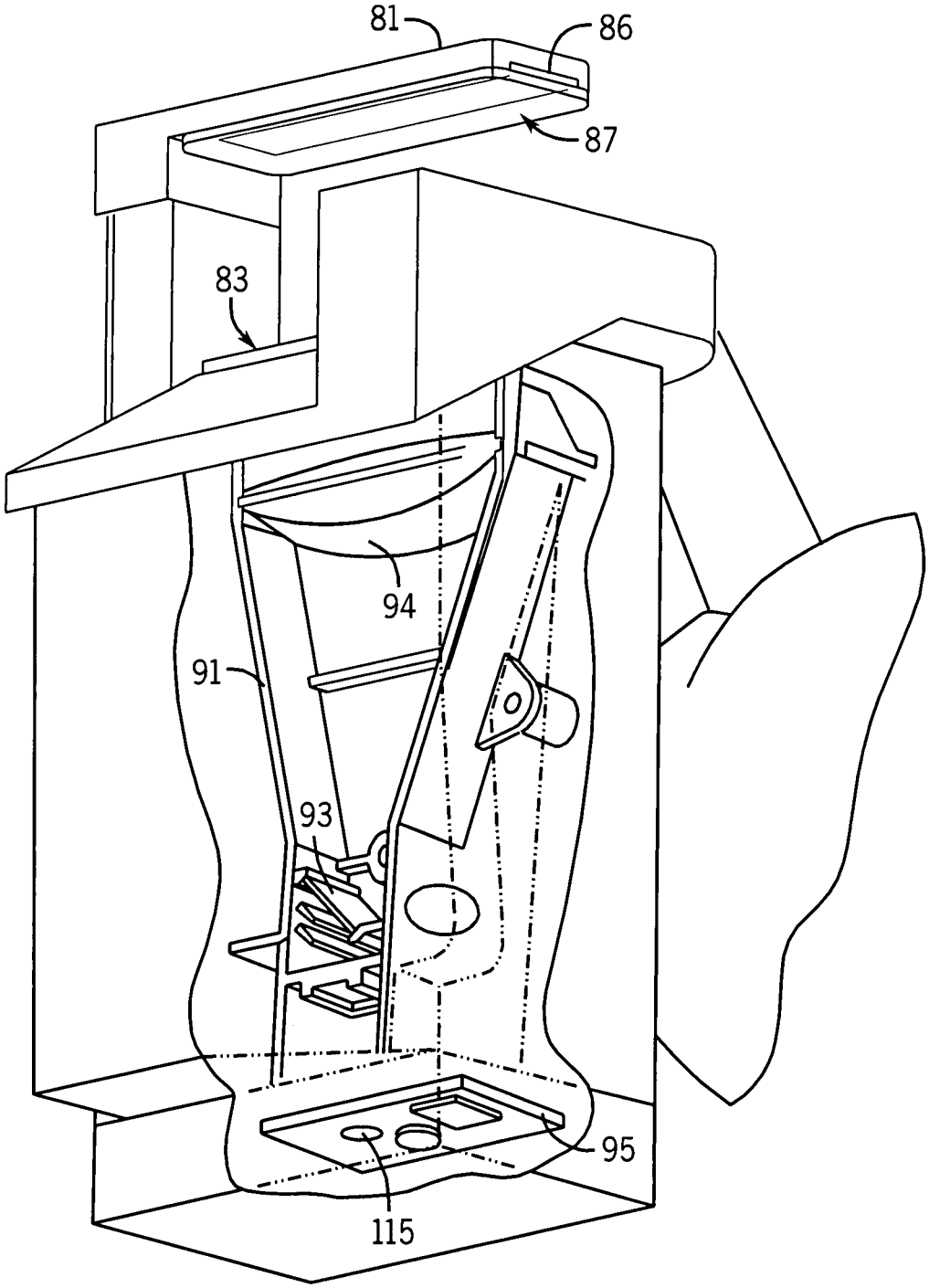
FIG. 9 is a front perspective view of a sensor assembly of the present invention with parts broken away for a view of internal parts.

The details of the optical sensor and detector assembly 90 are illustrated in FIGS. 7, 8 and 9. The telecentric lens 94 is mounted in a framework 91. A source 92 of LED illumination is mounted in the framework 91 to direct illumination to a reflective and refractive element 93 that will reflect light upwardly along axis 89 and through slot 88 and transparent member 83 seen in FIG. 7. From there, it will travel to the reflector 86, 87 unless blocked by a portion of a coin 14. After reflection, the light will travel back along the axis 89 to reflective and refractive element 93, but this time the light will pass through the element 93 rather than being reflected, and it will travel to the detector on the circuit board 95.

As seen in FIGS. 7 and 8, the telecentric lens 94 can be disposed on an axis 89 that is at an angle in a range from two degrees to thirty degrees from vertical, so as to block reflections from the cantilevered portions of the coins 14. The telecentric lens 94 in FIGS. 7 and 8 is more actually disposed on an axis that is at an angle of five degrees from vertical.

Referring to FIGS. 10A-10F, alloy detection is based on two inductive coils 98, 99 with a diameter of D=5.6 mm for the determination of the core and surface alloy. The coils 98, 99 are excited with a frequency of 160 kHz for the core alloy sensor 98 and 950 kHz for the surface alloy sensor 99. To pick up the magnetic property of the coin, a Hall effect sensor 97 is chosen and placed just beside the coils 98, 99. Another coil 65*a* is implemented into the rail 65 to measure the thickness of the coin, wherein the thickness measurement is also dependent on the edge alloy of the coin. A line sensor in the optical detector and sensor 90 below a slot opening 88 determines the diameter and is also used for triggering the different coin positions.

The optical sensor and detector 90 is a customized version of a sensor available under the trade name "Parcon" from Baumer Electric AG, Frauenfeld, Switzerland. The sensor produces an almost parallel IR beam, that leaves the sensor, is reflected by a reflector and comes back to the sensor almost parallel. It is then focused on a detector in the form of a linear array diode with 128 pixels. The efficiency of the reflector is such that illumination times of less than 0.1 ms are achievable. A microelectronic CPU 111 reads through all the pixels and then determines the edge of the object. It also performs some interpolation between pixels to get a higher resolution. Nominal resolution is 1 pixel which equals 0.2 mm in distance. Interpolation within ½-¼ pixel is possible which means a resolution in the range of 0.1-0.05 mm.

There are two definitions of system speed for this sensor:

1. 4500 coins of 17 mm (radius)/1 minute=>2550 mm/s
2. 19.37 rad is at 153 mm radius=>2963 mm/s The sensor resolution is about 0.1 mm.

When the coin passes the sensor 90 the maximum value determines the coin diameter. The sensor 90 is able to capture the maximum diameter or within an allowable tolerance.

Figure 10A:
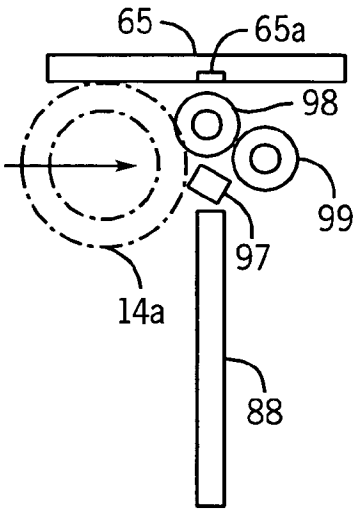
FIGS. 10A to 10F are schematic diagrams showing the operation of the optical, alloy and Hall effect sensors in identifying a large coin.
Figure 10B:
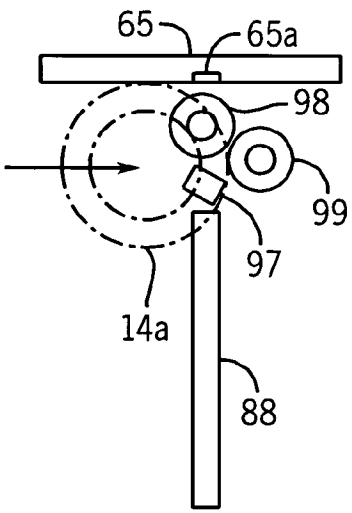
Figure 10C:
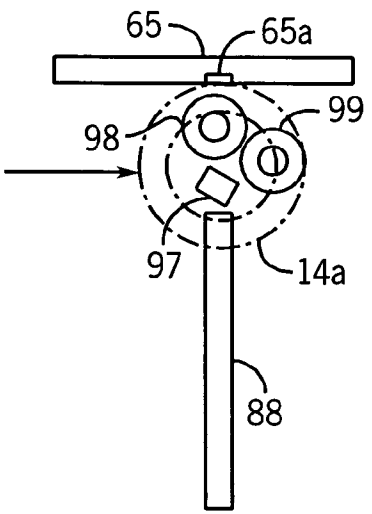
Figure 10D:
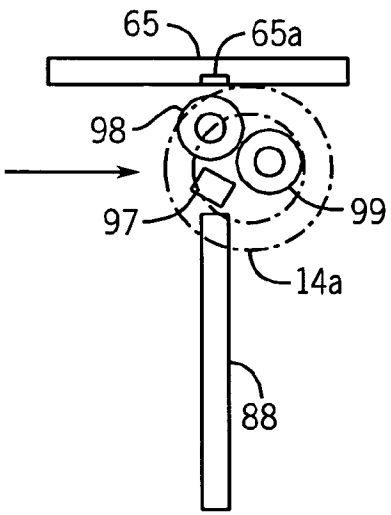
Figure 10F:
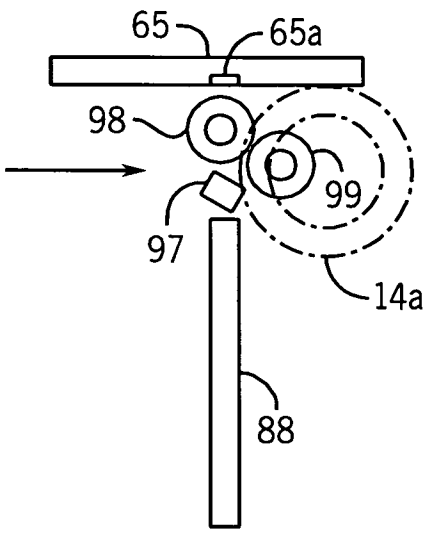
Figure 10E:
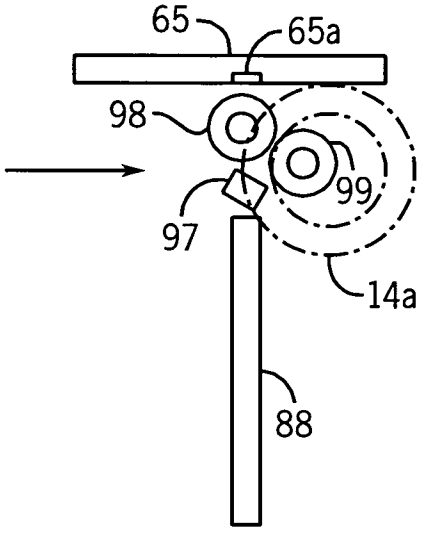
Figure 12:
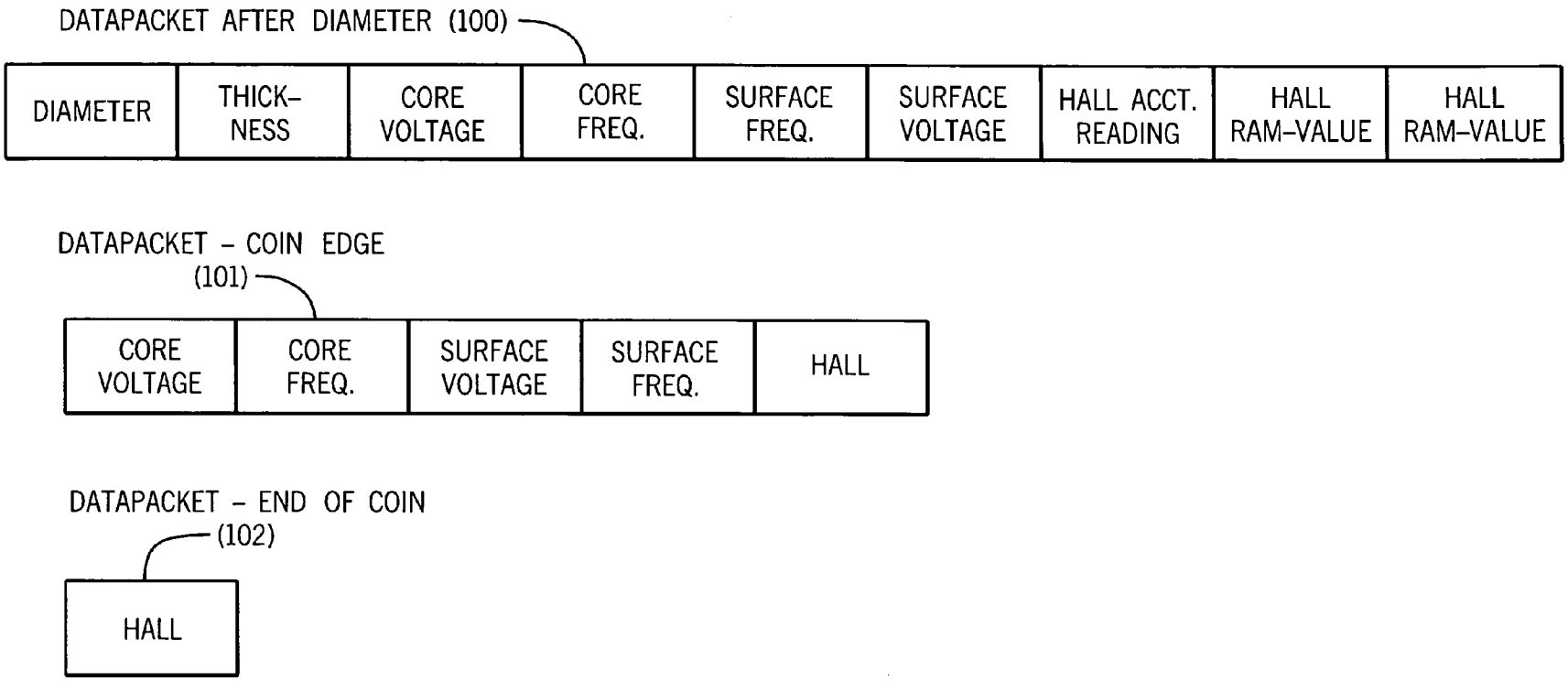
FIG. 12 is map of the data packet transmitted by the sensor assembly to a machine controller.
Figure 13:
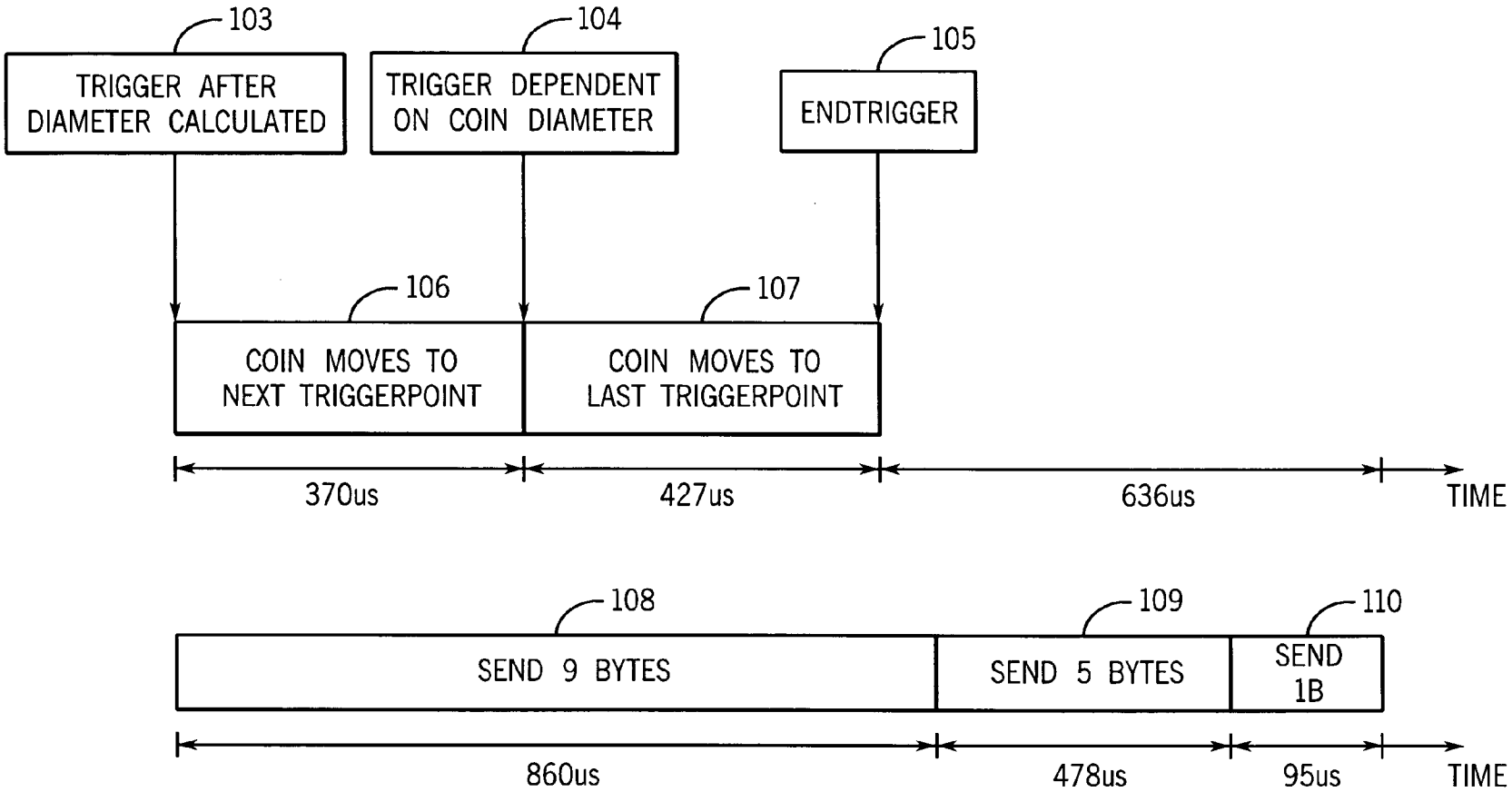
FIG. 13 is a timing diagram showing the data transfer from the sensor assembly to a machine controller.

As seen in FIG. 10A, the start position is detected when the coin 14*a* runs into the optical detection range represented by the slot opening 88. The measurement cycle for each coin starts at this position. Data from the Hall effect sensor 97 are continuously read out through the positions in FIGS. 10B and 10C and are buffered to a memory on the circuit board 95 (FIG. 9). As soon as the sensor assembly 90 is able to calculate the diameter of the coin 14*a* in FIG. 10D (also represented by block 103 in FIG. 13), the next trigger is set (as represented by block 106 in FIG. 13) and the thickness and alloy measurements including the actual reading of the Hall effect are obtained and processed according to the diameter sensed for the coin (as represented by block 104 in FIG. 13). The coin then moves onto the last trigger point shown physically in FIG. 10F and schematically as block 105 in FIG. 13. A data stream, as mapped in FIGS. 12 and 13 is transmitted through the serial data link 113 (FIG. 14) to the machine controller in three time slots 108, 109, 110 (FIG. 13). The data bytes in these packets 100, 101 and 102 are mapped in FIG. 12.

Figures 11A, 11B, 11C, 11D:
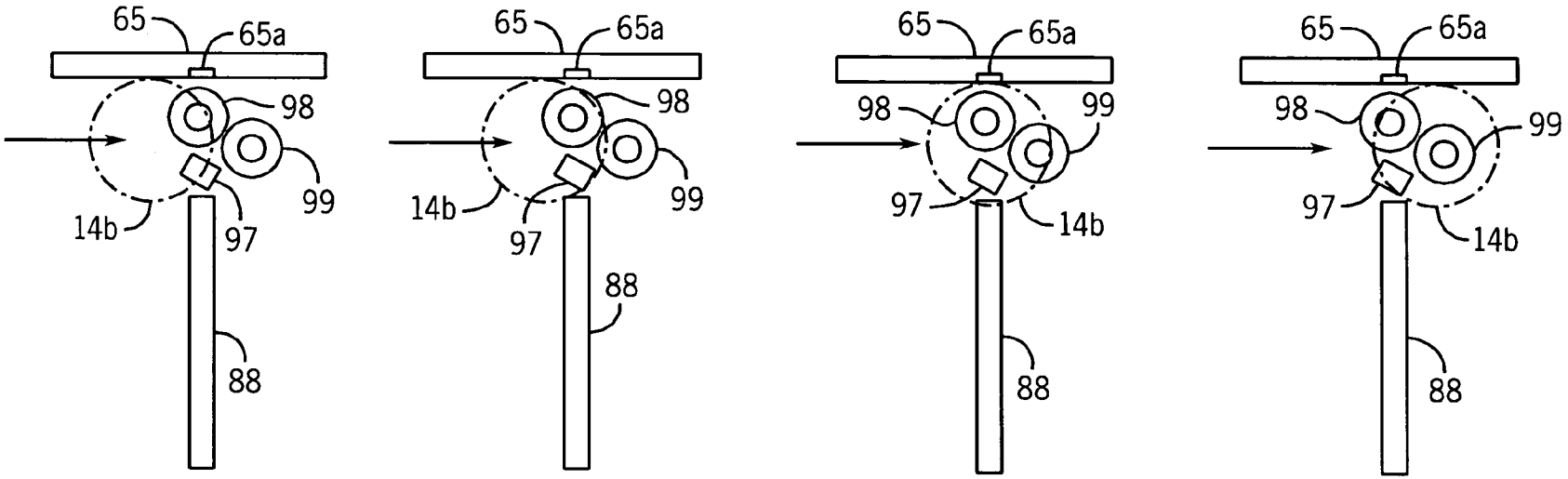
FIGS. 11A to 11D are schematic diagrams of the operation of the optical, alloy and Hall effect sensors in identifying the smallest coin.

FIGS. 11A through 11D show the case for smaller coins 14*b*. Here FIG. 11A corresponds to FIG. 10A for the larger coins 14*a*. FIGS. 11B through 11D correspond to FIGS. 10D through 10F for larger coins. There are no Hall data collection points corresponding to FIGS. 10B and 10C for smaller coins 14*b*. The data stream is simply filled up with the "Hall Act. Reading" of the diameter trigger, because the Hall effect sensor data are not containing any further information of the coin. The accumulated RAM values of the Hall effect sensor 97 are rejected in this case. The third trigger position in FIG. 11C is coin dependent and is calculated based on the measured diameter. This provides readings from the edge of the coin. The end position of the coin is the location where the coin does not cover the optical detection slot 88 anymore as seen in FIG. 11D.

The first data packet 100 (FIG. 12) is transmitted right after the diameter of the coin is detected. Assuming a maximum speed of $v_{max}$=3 m/s, the time the coin takes to the following trigger position is dt=370 μs. To the last trigger-point it takes 427 μs. The time it takes for sending all the readings through the serial link is 1.433 ms at a data rate of 115.2 kBaud. The time of 636 μs that the sensor needs to finish data transfer is less than the time it would take to send new data from the following coin.

This sensor concept acquires only a minimum of coin data that are necessary to asses a coin. Even at maximum speed of 3 m/s it works well using an asynchronous serial link at a data rate of 115.2 kHz. Readings of a center part and an outer ring for a possible 2 Euro and 1 Euro coin are taken, and furthermore two additional items of information for the coin are taken with the Hall effect sensor. This should help to identify and offsort counterfeit coins. The concept is optimized relating to constant readings per coin and the asynchronous serial link of 115.2 kBaud.

Figure 14:
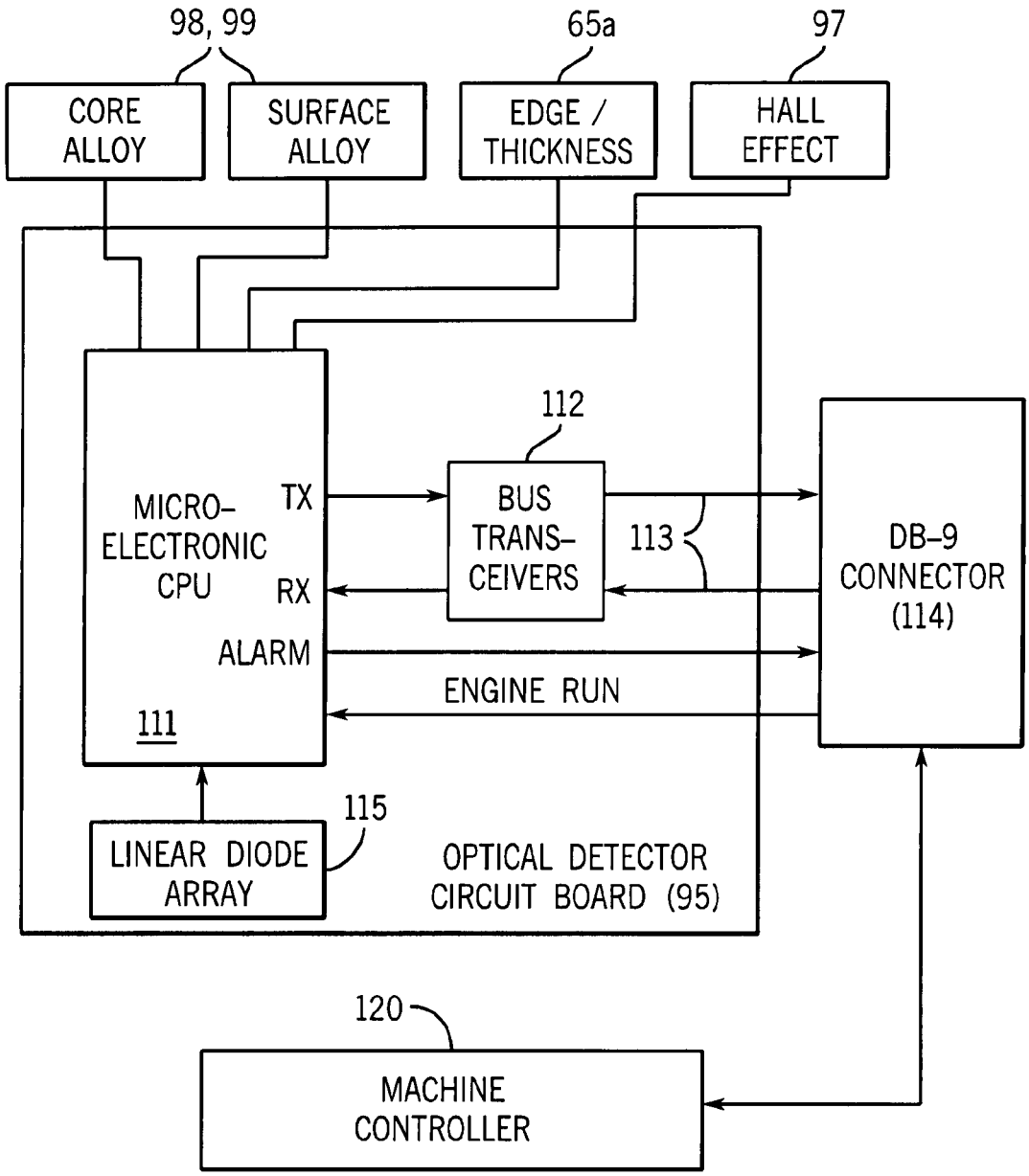
FIG. 14 is a block diagram of the electronics in the sensor assembly of FIGS. 6-9.

The details of the optical detector circuit board 95 are shown in FIG. 14. A microelectronic CPU 111 receives inputs from the alloy, Hall effect and edge sensors 65*a*, 97, 98 and 99. It performs computations and transmits the data seen in FIG. 12 to a machine controller through a serial bus 113 have transmit (TX) and receive (RX) portions. The serial bus 113 is connected through bus transceivers 112 of a type common in the art to a DB-9 serial data link connector 114. One line is utilized for an ENGINE RUN signal that is received by the CPU 111, when main motor of the machine is running under power. One line is also used for an ALARM signal to the machine controller. The detector is a linear diode array 115 that provides its data to the CPU 111 for the coin size determination.

Further details of the coin handling machine can be found in a copending application filed on even date herewith and entitled, "Method and Sensor for Sensing Coins for Valuation," the disclosure of which is hereby incorporated by reference.

This has been a description of preferred embodiments of the invention. Those of ordinary skill in the art will recognize that modifications might be made while still coming within the scope and spirit of the present invention as will become apparent from the appended claims.

We claim:

1. A dust prevention system for a coin sensor for detecting a size of individual ones of a plurality of coins being moved within a coin handling machine, the system comprising:

a stationary and substantially horizontal coin track;

a coin moving element positioned for pressing down on outside portions of the coins as the coins move along the coin track;

an upper optical element and a lower optical element that are spaced apart for illuminating a portion of a coin as a plurality of coins move along the substantially horizontal coin track in single file, the coin track having an inside edge;

wherein the coin track is stationary and is narrower than the coins passing over the coin track, the coin track having a width such that when coins pass along the coin track, the coins have portions that are cantilevered over the inside edge of the coin track by the pressing down on the coins provided by the coin moving element to enable illumination and detection of portions of the coins extending beyond the inside edge of the coin track;

wherein the lower optical element has a transparent cover; and wherein the inside edge of the coin track is spaced above the transparent cover for the lower optical element and is spaced below the upper optical element to prevent accumulation of dust on the upper optical element and on the transparent cover for the lower optical element.

2. The dust prevention system of claim 1, wherein a fan is positioned adjacent to and below the transparent cover for the lower optical element for blowing dust off the transparent cover during operation of the coin handling machine.

3. The dust prevention system of claim 2, wherein the lower optical element further comprises an illumination source and an optical detector, and wherein the upper optical element further comprises an optical reflector.

4. The dust prevention system of claim 3, wherein the optical reflector comprises a reflective sheet material and a second transparent cover disposed over the reflective sheet material.

5. The dust prevention system of claim 1, wherein the upper and lower optical elements each have a transparent cover; and wherein each transparent cover has a coating of conductive transparent material that is electrically grounded to neutralize static attraction of dust particles.

6. The dust prevention system of claim 5, wherein the coating consists essentially of an indium-tin oxide material.

7. The dust prevention system of claim 5, wherein the lower optical element further comprises an illumination source and an optical detector, and wherein the upper optical element further comprises an optical reflector.

8. The dust prevention system of claim 7, wherein the optical reflector positioned above an inside edge of the coin track; and wherein the illumination source is positioned below the inside edge of the coin track.

9. The dust prevention system of claim 1, wherein the lower optical element further comprises an optical detector that is positioned below the inside edge of the coin track.

10. The dust prevention system of claim 9, further comprising a telecentric lens positioned between the optical detector and the coin track, such that the portion of each coin passing the optical detector is seen to have an apparent size and configuration independent of a variation in distance of the coin from the telecentric lens as each coin moves along the coin track.

11. The dust prevention system of claim 1, wherein the lower optical element further comprises an illumination source and an optical detector, and wherein the upper optical element further comprises an optical reflector.

12. The dust prevention system of claim 3, wherein a spacing between the coin track and the reflector is in a range from 2.5 cm to 7.5 cm.

13. The dust prevention system of claim 1, further comprising:

a coin core alloy composition sensor for detecting coin core alloy composition as the coin passes over the coin track;

a coin surface alloy composition sensor for detecting coin surface alloy composition as the coin passes over the coin track;

a Hall effect sensor for detecting a magnetic condition of a coin as the coin passes over the coin track; and further comprising an electronic control portion that receives data from the coin core alloy composition sensor and the coin surface alloy sensor and a Hall effect sensor for comparison with stored values for a plurality of coin specifications to determine if the coin should be accepted as meeting any one of the coin specifications or should be rejected.

14. The dust prevention system of claim 13, further comprising:

an edge sensor disposed along a reference edge along the coin track for sensing a parameter from an edge of the coin as the coin passes the coin path insert; and wherein the electronic control portion receives data from the edge sensor for comparison with stored values for a plurality of coin specifications to determine if the coin should be accepted as meeting any one of the coin specifications or should be rejected.

15. The dust prevention system of claim 14, in which the coin track, the optical detector, the coin core alloy composition sensor, the coin surface alloy and the edge sensor, and the Hall effect sensor and the electronic control portion are all housed in a coin sensor housing assembly.

16. A method of dust prevention for a coin sensor for detecting a size of individual ones of a plurality of coins being moved within a coin handling machine, the method comprising:

providing a stationary coin track having an inside edge that is elevated above a lower optical element and above a transparent cover for the lower optical element for receiving coins in a single file with the coin track being narrower than a width of the coins so that portions of the coins extend beyond the inside edge of the coin track;

pressing down on outside portions of the coins to cantilever the coins including portions of the coins extending beyond the inside edge of the coin track;

illuminating a portion of each coin extending beyond the inside edge of the coin track as the coins move along the coin track; and blowing off dust that tends to accumulate on the transparent cover for the lower optical element, wherein said transparent cover is spaced below the coin track, wherein said lower optical element includes an optical detector for detecting a size of a coin moving along the coin track past the optical detector.

17. The dust prevention method of claim 16, wherein a fan is positioned adjacent a first transparent cover for the lower optical element for blowing dust off the first transparent cover during operation of the coin handling machine.

18. The dust prevention method of claim 17, further comprising coating the first transparent cover with a tin-indium coating to reduce static electric attraction of dust particles.

19. The dust prevention method of claim 16, wherein the lower optical element further comprises an illumination source, and further comprising an upper optical element that further comprises an optical reflector.

20. The dust prevention method of claim 19, wherein the optical reflector comprises a reflective sheet material and a second transparent cover disposed over the reflective sheet material.

21. The dust prevention method of claim 20, further comprising coating the second transparent cover with a conductive transparent material that is electrically grounded to reduce static electric attraction of dust particles.

22. The dust prevention system of claim 2, further comprising a duct positioned adjacent to the transparent cover for conveying air from the fan for blowing dust off the transparent cover during operation of the coin handling machine.

23. The dust prevention system of claim 1, wherein the coin track does not have a window of transparent material over which the coins pass for optical detection.

24. A coin handling machine incorporating a dust prevention system for a coin sensor for detecting a size of individual ones of a plurality of coins being moved within the coin handling machine, the coin handling machine comprising:

a stationary and substantially horizontal coin track;

an upper optical element and a lower optical element that are spaced apart for illuminating a portion of a coin as a plurality of coins move along said coin track in single file, the coin track having an inside edge over which portions of the coins passing over the coin track are cantilevered for illumination and detection;

wherein the lower optical element has a transparent cover; and wherein the inside edge of the coin track is spaced above the transparent cover for the lower optical element and is spaced below the upper optical element to prevent accumulation of dust on the upper optical element and on the transparent cover for the lower optical element.

* * * * *